US006963701B2

(12) United States Patent
Inukai

(10) Patent No.: US 6,963,701 B2
(45) Date of Patent: Nov. 8, 2005

(54) IMAGE FORMING DEVICE WITH BIAS APPLYING POWER SOURCE FOR TRANSFER ROLLER

(75) Inventor: Katsumi Inukai, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/606,837

(22) Filed: Jun. 27, 2003

(65) Prior Publication Data

US 2004/0057740 A1 Mar. 25, 2004

(30) Foreign Application Priority Data

Jun. 28, 2002 (JP) ..... P2002-188999

(51) Int. Cl.[7] ..... G03G 15/16
(52) U.S. Cl. ..... 399/66; 399/88; 399/314
(58) Field of Search ..... 399/50, 53, 55, 399/66, 314, 88

(56) References Cited

U.S. PATENT DOCUMENTS 5,343,019 A 8/1994 Nashida et al.
5,684,685 A 11/1997 Komatsu et al.
5,903,183 A * 5/1999 Inukai

FOREIGN PATENT DOCUMENTS

| | | | |
|---|---|---|---|
| JP | A 5-241477 | 9/1993 | |
| JP | A 7-64410 | 3/1995 | |
| JP | A 8-22205 | 1/1996 | |
| JP | 10-301408 | 11/1998 | |
| JP | 2001255761 A * | 9/2001 | ..... G03G 15/16 |

* cited by examiner

*Primary Examiner*—Arthur T. Grimley
*Assistant Examiner*—Ryan Gleitz
(74) *Attorney, Agent, or Firm*—Oliff & Berridge, PLC

(57) ABSTRACT

An image forming device includes a powere source with a forward transfer bias circuit for applying a forward transfer bias to the transfer roller based on a detected resistance Z, during image transfer, and a reverse transfer bias circuit for applying a reverse bias during a cleaning operation, both through constant current control, both circuits connected in series, During constant current control, the forward bias circuit detects the resistance value Z on the transfer roller using the equation $Z=(\alpha Ve-Ri_1)/i_1$, where $\alpha$ is the ratio of voltages in the secondary winding and auxiliary winding in the transformer of a forward transfer booster/rectifying and smoothing circuit, Ve is the output voltage from a forward transfer output voltage detecting circuit, R is the resistance in a discharge resistor of a reverse transfer booster/rectifying and smoothing circuit, and $i_1$ is the constant current setting.

9 Claims, 2 Drawing Sheets

IMAGE FORMING DEVICE WITH BIAS APPLYING POWER SOURCE FOR TRANSFER ROLLER

BACKGROUND OF THE INVENTION

1. Field of the Invention

The present invention relates to an image forming device, such as a laser printer. More particularly, the invention relates to a bias applying power source for applying a bias (dc voltage) to a transfer roller.

2. Description of the Prior Art

Ordinarily, image forming devices such as laser printers include a photosensitive drum and, provided around this photosensitive drum in the direction of the drum's rotation, a charging device, a scanning device, a developing roller, and a transfer roller.

As the photosensitive drum rotates, the charging device applies a uniform charge to the surface of the photosensitive drum. Next, the surface of the photosensitive drum is exposed to the high-speed scanning of a laser beam emitted from the scanning device to form a latent image based on image data. When the surface of the photosensitive drum is rotated into the developing roller, toner carried on the surface of the developing roller is supplied to the latent image formed on the photosensitive drum and is selectively carried thereon, forming a toner image (visible image). Subsequently, the toner image carried on the surface of the photosensitive drum is rotated in opposition to the transfer roller and is transferred to a sheet of paper passing between the photosensitive drum and the transfer roller by a transfer bias applied to the transfer roller.

Cleaning devices well known in the art are provided in these types of image forming devices to clean toner deposited on the transfer roller before or after the image forming operation or between the feeding of each sheet of paper. This type of image forming device includes a power source for applying a transfer bias to the transfer roller. The power source includes a forward bias applying circuit and a reverse bias applying circuit that are connected to the transfer roller in series. The forward bias applying circuit applies a forward transfer bias that is lower than the surface potential of the photosensitive drum contacting the transfer roller. The reverse bias applying circuit applies a reverse transfer bias that is higher than the surface potential of the photosensitive drum.

During a transfer operation, the forward bias applying circuit applies a forward transfer bias to the transfer roller to transfer the toner image onto the paper. During a cleaning operation, the reverse bias applying circuit applies a reverse transfer bias to the transfer roller in order to electrically expel toner deposited on the transfer roller onto the surface of the photosensitive drum.

In these types of transfer bias applying power sources, the forward bias applying circuit is usually controlled by a constant current, in order that a constant transfer current can be applied at all times, even when the resistance on the transfer roller end varies due to ambient changes, for example (here and hereafter the resistance value includes the photosensitive drum and the paper). In this type of constant current control, the transfer current value is determined by detecting the output voltage of the forward bias applying circuit with a detection circuit provided therein and calculating the resistance on the transfer roller end based on this output voltage.

However, the forward and reverse bias applying circuits are connected to the transfer roller in series in this type of power source (in other words, the transfer roller has only one output terminal). Accordingly, when calculating the resistance on the transfer roller based simply on the output voltage from the forward bias applying circuit detected by the detection circuit, the calculated resistance contains the resistance in the reverse bias applying circuit as an error, preventing an accurate calculation of the resistance value on the transfer roller end.

SUMMARY OF THE INVENTION

In view of the foregoing, it is an object of the present invention to provide an image forming device having a simple construction that is capable of accurately detecting the resistance of an object to be biased and capable of calculating a suitable constant current value.

These objects and others will be attained by an image forming device including an object to be biased, a bias applying power source, and resistance detecting means. The object is, for example, a transfer roller. When the transfer roller is forward biased, it transfers a developer image on a photosensitive drum onto a sheet of paper. The bias applying power source applies a bias to the object. The bias applying power source includes a forward bias applying circuit and a reverse bias applying circuit connected in series to the object. The forward bias applying circuit applies the forward bias to the object according to a constant current control and includes a voltage detecting circuit that detects an output voltage from the forward bias applying circuit. The resistance detecting means is provided for detecting a resistance on the object based on the output voltage detected by the voltage detecting circuit and a resistance on the reverse bias applying circuit when the forward bias applying circuit executes constant current control.

With this configuration, the resistance detecting means detects the resistance on the object based on the output voltage from the forward bias applying circuit detected by the voltage detecting means and the resistance on the reverse bias applying circuit. Hence, with a simple construction, the present invention can accurately detect the resistance in the object and can thereby accurately calculate an appropriate constant current value.

According to another aspect of the invention, there is provided an image forming device that includes a photosensitive member that forms a latent image thereon; a developing roller that develops the latent image and provides a toner image using toner; a transfer roller that transfers the toner image onto a sheet of paper; a bias applying circuit that outputs a voltage to the transfer roller, a closed circuit being configured by at least the bias applying circuit and the transfer roller, a resistance being imposed on the bias applying circuit; a voltage detecting circuit that detects the voltage output from the bias applying circuit; and a controller that detects the resistance imposed on the bias applying circuit. A constant current controlling circuit may further be provided that controls a current flowing in the closed circuit to be a predetermined constant based on the voltage detected by the voltage detecting circuit and the resistance detected by the controller.

DETAILED DESCRIPTION OF THE PREFERRED EMBODIMENT

Figure 1:
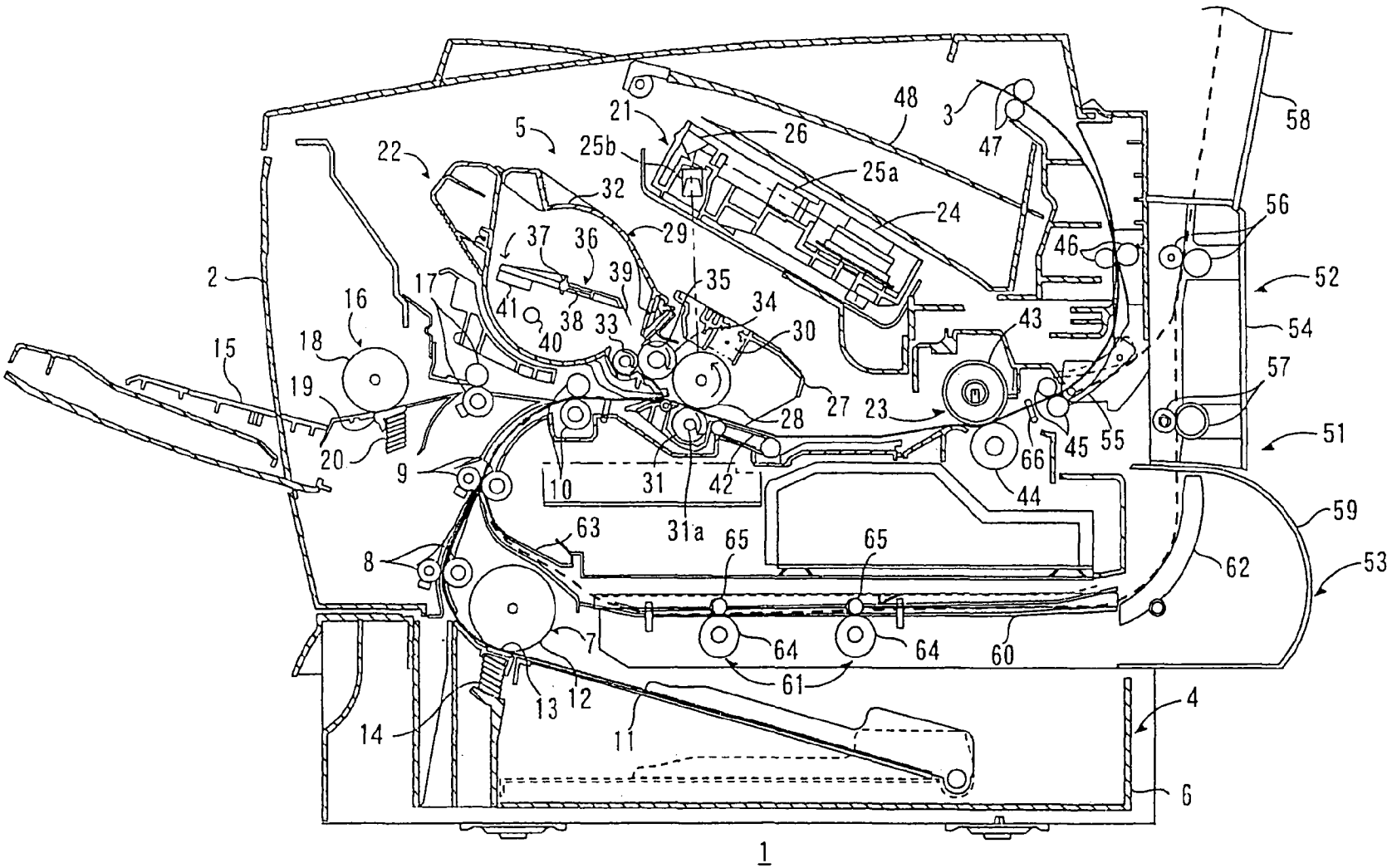
FIG. 1 is a side cross-sectional view showing the relevant parts of a laser printer according to the preferred embodiment, serving as the image forming device of the present invention.

An image forming device according to a preferred embodiment of the present invention will be described while referring to the accompanying drawings. FIG. 1 is a side cross-sectional view showing the relevant parts of a laser printer 1 according to the preferred embodiment, which serves as the image forming device of the present invention. The laser printer 1 employs an electrophotographic system to form images using a non-magnetic single-component developing method.

As shown in FIG. 1, the laser printer 1 includes a feeder unit 4 for supplying sheets 3 of paper, an image forming unit 5 for forming images on the supplied sheets 3, a main casing 2 accommodating the feeder unit 4 and image forming unit 5, and the like.

The feeder unit 4 is disposed in the bottom section of the main casing 2 and includes a feed tray 6 detachably mounted in the feeder unit 4, a paper supply mechanism 7 provided on one side end of the feed tray 6, pairs of conveying rollers 8 and 9 provided downstream from the paper supply mechanism 7 in the direction that the sheets 3 are conveyed (hereinafter upstream or downstream in the conveying direction of the sheets 3 will be abbreviated as simply "upstream" or "downstream"), and register rollers 10 provided downstream from the conveying rollers 8 and 9.

The feed tray 6 is shaped like an open-top box and is capable of accommodating stacked sheets 3. The feed tray 6 can be removed from or inserted into the bottom section of the main casing 2 in a horizontal direction. A paper pressing plate 11 is disposed in the feed tray 6. A plurality of sheets 3 can be stacked on the paper pressing plate 11. The paper pressing plate 11 is pivotably supported on the end farthest from the paper supply mechanism 7, enabling the end nearest the paper supply mechanism 7 to move vertically. A spring not shown in the drawings is disposed on the underside of the paper pressing plate 11, urging the paper pressing plate 11 upward. As the number of sheets 3 stacked on the paper pressing plate 11 increases, the paper pressing plate 11 opposes the urging force of the spring and pivots downward about the supporting point on the end farthest from the paper supply mechanism 7.

The paper supply mechanism 7 includes a feed roller 12, a separating pad 13 in confrontation with the feed roller 12, and a spring 14 disposed on the underside of the separating pad 13. The urging force of the spring 14 presses the separating pad 13 against the feed roller 12.

The spring (not shown) on the underside of the paper pressing plate 11 urges the sheets 3 stacked on the paper pressing plate 11 toward the feed roller 12, such that the uppermost sheet 3 in the stack is conveyed by the rotation of the feed roller 12 between the feed roller 12 and separating pad 13. Through the cooperative operations of the feed roller 12 and separating pad 13, paper is separated and fed into the laser printer 1 one sheet at a time. The supplied sheet 3 is conveyed to the register rollers 10 by the pairs of conveying rollers 8 and 9.

At a prescribed timing, the pair of register rollers 10 conveys the sheet 3 to an image forming position. The image forming position is the position at which toner (visible image) is transferred from a photosensitive drum 28 described later to the sheets 3, that is, a transfer position at which the photosensitive drum 28 contacts a transfer roller 31, described later.

The feeder unit 4 of the laser printer 1 further includes a multipurpose tray 15 on which is stacked sheets 3 of an arbitrary size, a multipurpose feeding mechanism 16 for feeding the sheet 3 stacked on the multipurpose tray 15 into the laser printer 1, and multipurpose conveying rollers 17.

The multipurpose feeding mechanism 16 includes a multipurpose feeding roller 18, a multipurpose separating pad 19 in confrontation with the multipurpose feeding roller 18, and a spring 20 disposed on the underside of the multipurpose separating pad 19. The urging force of the spring 20 presses the multipurpose separating pad 19 against the multipurpose feeding roller 18.

The topmost sheet among the sheets 3 stacked on the multipurpose tray 15 becomes interposed between the multipurpose feeding roller 18 and the multipurpose separating pad 19 due to the rotation of the multipurpose feeding roller 18. Through the cooperative operations of the multipurpose feeding roller 18 and multipurpose separating pad 19, the sheets 3 are separated and fed into the laser printer 1 one sheet at a time. The multipurpose conveying rollers 17 convey the separated sheets 3 toward the register rollers 10.

The image forming unit 5 includes a scanning unit 21, a processing unit 22, a fixing unit 23, and the like. The scanning unit 21 is provided in the top section of the main casing 2 and includes a laser light-emitting unit (not shown), a polygon mirror 24 that can be driven to rotate, lenses 25*a* and 25*b*, a reflecting mirror 26, and the like. As indicated by the dotted line in FIG. 1, a laser beam is emitted by the laser light-emitting unit based on image data and sequentially passes through or reflects off of the polygon mirror 24, lens 25*a*, reflecting mirror 26, and lens 25*b*. The laser light is irradiated in a high-speed scanning operation on the surface of the photosensitive drum 28 in the processing unit 22.

The processing unit 22 is disposed below the scanning unit 21 and is detachably mounted in the main casing 2. The processing unit 22 includes a drum cartridge 27 that accommodates the photosensitive drum 28, a developer cartridge 29, a scorotron charger 30, and the transfer roller 31 serving as the object to be biased.

The developer cartridge 29 is detachably mounted in the drum cartridge 27 and includes a toner hopper 32 and, provided to the side of the toner hopper 32, a supply roller 33, a developing roller 34, and a thickness regulating blade 35.

The filling compartment 32 is filled with a non-magnetic, single-component toner having a positive charge. The toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1–C4) acrylate, or alkyl (C1–C4) meta acrylate. The polymerized toner is formed as particles substantially spherical in shape in order to have excellent fluidity. The toner is compounded with a coloring agent such as carbon black or wax, as well as an additive such as silica to improve fluidity. The diameter of the toner particles is about 6–10 $\mu$m.

The toner hopper 32 is also provided with an agitator 36. The agitator 36 includes a rotating shaft 37 rotatably supported in the center of the toner hopper 32, a scraping blade 38 disposed around the rotating shaft 37, and a film 39 affixed to the free end of the scraping blade 38. As the rotating shaft 37 of the agitator 36 rotates in the direction of the arrow (counterclockwise in FIG. 1), the scraping blade 38 moves around the inner periphery of the toner hopper 32. The film 39 on the end of the scraping blade 38 scrapes up toner in the toner hopper 32 and conveys the toner toward the supply roller 33 described below.

A cleaning member 41 is disposed on the rotating shaft 37 opposite the scraping blade 38. The cleaning member 41 functions to clean a window 40 provided in a side wall of the toner hopper 32 for detecting the amount of remaining toner.

The feed roller 33 is disposed to the side of the toner hopper 32 and can rotate in the direction indicated by the arrow in FIG. 1 (clockwise). The feed roller 33 is formed of a metal roller shaft covered by a roller formed of an electrically conductive urethane sponge material.

The developing roller 34 is disposed to the side of the feed roller 33 and can rotate in the direction indicated by the arrow in FIG. 1 (clockwise). The feed roller 34 is also configured of a metal shaft covered by a roller formed of an electrically conductive resilient material. More specifically, the roller part of the developing roller 34 is formed of an electrically conductive urethane rubber or silicon rubber including fine carbon particles, the surface of which is coated with a urethane rubber or silicon rubber including fluorine. A prescribed developing bias in relation to the photosensitive drum 28 is applied to the developing roller 34.

The supply roller 33 and developing roller 34 are disposed in confrontation with each other. The supply roller 33 contacts the developing roller 34 with a degree of pressure.

The thickness regulating blade 35 is disposed above the supply roller 33 extending along the axial direction of the developing roller 34 in confrontation with the top of the developing roller 34. The thickness regulating blade 35 includes a leaf spring member (not shown) mounted on the developer cartridge 29 and a pressing member provided on the end of the leaf spring member. The pressing member has a semicircular cross section and is formed of an insulating silicon rubber. With this construction, the elastic force of the leaf spring member causes the pressing member to pressingly contact the surface of the developing roller 34.

Toner discharged from the toner hopper 32 is supplied to the developing roller 34 by the rotation of the supply roller 33. At this time, the toner is positively tribocharged between the feed roller 33 and developing roller 34. As the developing roller 34 rotates, the toner supplied to the surface of the developing roller 34 passes between the developing roller 34 and the pressing member of the thickness regulating blade 35, thereby maintaining a uniform thickness of toner on the surface of the developing roller 34.

The photosensitive drum 28 is disposed to the side of the developing roller 34 and can rotate in the drum cartridge 27 in the direction indicated by the arrow (counterclockwise in FIG. 1) while in confrontation with the developing roller 34. The photosensitive drum 28 is formed of a main drum body that is grounded and a surface layer formed of a positively charged photosensitive layer of polycarbonate or the like.

The scorotron charger 30 is supported in the drum cartridge 27 above the photosensitive drum 28 and separated a prescribed distance from the photosensitive drum 28 so as not to contact the surface of the same. The scorotron charger 30 is a positive charging scorotron charger having a charging wire formed of tungsten or the like from which a corona discharge is generated. The scorotron charger 30 functions to charge the entire surface of the photosensitive drum 28 with a uniform positive polarity.

As the photosensitive drum 28 rotates, the scorotron charger 30 generates a positive charge across the entire surface of the photosensitive drum 28. Subsequently, the surface of the photosensitive drum 28 is exposed to the high-speed scanning of a laser beam emitted from the scanning unit 21, forming latent images on the surface based on prescribed image data.

Next, the positively charged toner carried on the surface of the developing roller 34 is brought into contact with the photosensitive drum 28 as the developing roller 34 rotates. At this time, the latent images formed on the surface of the photosensitive drum 28 are transformed into visible images when the toner is selectively attracted to portions of the photosensitive drum 28 that were exposed to the laser beam and, therefore, have a lower potential than the rest of the surface having a uniformly positive charge. In this way, a reverse image is formed.

The transfer roller 31 is disposed below the photosensitive drum 28 and in opposition thereto, and is supported in the drum cartridge 27 so as to be capable of rotating in the direction of the arrow (clockwise in FIG. 1). The transfer roller 31 includes a metal roller shaft 31*a* covered by a roller member that is formed of a resilient ion-conducting material. A transfer bias applying power source 71 (see FIG. 2) described later is connected to the metal roller shaft 31*a* of the transfer roller 31 for applying a forward transfer bias to the metal roller shaft 31*a* during a transfer process and a reverse transfer bias during a cleaning process.

In a printing process, the register rollers 10 adjust the sheet 3 to a prescribed register position and feed the sheet 3 toward the photosensitive drum 28, such that the rotating photosensitive drum 28 contacts the surface of the sheet 3. A forward transfer bias is applied to the transfer roller 31, causing the toner image (visible image) carried on the surface of the photosensitive drum 28 to be transferred to the sheet 3 as the sheet 3 passes between the photosensitive drum 28 and transfer roller 31. After the toner image is transferred in this way, the sheet 3 is conveyed to the fixing unit 23 by a conveying belt 42.

The fixing unit 23 is disposed to the side of and downstream from the processing unit 22. The fixing unit 23 includes a heat roller 43, a pressure roller 44, and a pair of conveying rollers 45. The heat roller 43 includes a metal tube accommodating a halogen lamp as a heat source. The pressure roller 44 confronts the bottom surface of the heat roller 43 and applies pressure thereto. The conveying rollers 45 are disposed downstream from the heat roller 43 and pressure roller 44.

The heat from the heat roller 43 fixes the toner transferred onto the sheet 3 to the surface of the sheet 3 as the sheet 3 passes between the heat roller 43 and pressure roller 44. Subsequently, the conveying rollers 45 convey the sheet 3 to a pair of conveying rollers 46 and a pair of discharge rollers 47 disposed on the main casing 2.

The conveying rollers 46 are disposed downstream from the conveying rollers 45. The discharge rollers 47 are positioned above a discharge tray 48. The conveying rollers 45 convey the sheet 3 to the conveying rollers 46, which convey the sheet 3 to the discharge rollers 47. The discharge rollers 47 discharge the sheet 3 onto the discharge tray 48.

The laser printer 1 of the preferred embodiment employs what is known as a cleanerless developing system for recovering residual toner, wherein the developing roller 34 recovers toner remaining on the surface of the photosensitive drum 28 after the transfer roller 31 has transferred an image to the sheet 3. Use of this type of cleanerless developing system to recover residual toner can aid in the simplification of the construction of the laser printer by eliminating the need for a special part, such as a blade, for removing residual toner and a reservoir for recovering waste toner.

While described below in more detail the laser printer 1 of the preferred embodiment applies a reverse transfer bias to the transfer roller 31 before or after an image forming process or between each transfer operation in the image forming process. The reverse transfer bias electrically expels toner deposited on the transfer roller 31 onto the surface of the photosensitive drum 28, enabling the developing roller 34 to recover this toner along with the other residual toner on the surface of the photosensitive drum 28.

The laser printer 1 of the preferred embodiment is further provided with a reconveying unit 51 to enable images to be formed on both sides of the sheet 3. The reconveying unit 51 is integrally configured of a reversing mechanism 52 and a reconveying tray 53. The reversing mechanism 52 is attached to the back end of the main casing 2, while the reconveying tray 53 is detachably mounted in the main casing 2 and inserted over the feeder unit 4.

The reversing mechanism 52 includes a casing 54 mounted on the back panel of the main casing 2 and having a substantially rectangular cross section, a pair of reverse rollers 56, and a pair of reconveying rollers 57. A reverse guide plate 58 protrudes upward from the top of the casing 54.

A flapper 55 is disposed downstream from the conveying rollers 45 for selectively switching the direction in which the conveying rollers 45 convey the sheet 3, having an image formed on one surface, between a direction toward the conveying rollers 46 indicated by a solid line in the drawing and a direction toward the reverse rollers 56 indicated by a dotted line. The flapper 55 is rotatably supported near to and downstream from the conveying rollers 45 in the back section of the main casing 2. The sheet 3 having an image formed on one side surface and being conveyed by the conveying rollers 45 can be selectively guided toward either the conveying rollers 46 (solid line) or the reverse rollers 56 (dotted line) by toggling the excitation of a solenoid (not shown) on and off in order to pivot the flapper 55.

The pair of reverse rollers 56 is disposed in the top section of the casing 54 downstream from the flapper 55. The reverse rollers 56 are capable of rotating both forward and backward. The reverse rollers 56 first rotate in the forward direction to convey the sheet 3 toward the reverse guide plate 58, and subsequently rotate in the reverse direction to convey the sheet 3 in the opposite direction.

The pair of reconveying rollers 57 is provided in the casing 54 almost directly below the reverse rollers 56 and downstream therefrom. The reconveying rollers 57 can convey the sheet 3 conveyed in the reverse direction by the reverse rollers 56 to the reconveying tray 53.

The reverse guide plate 58 is a plate-shaped member that extends upward from the top of the casing 54 for guiding the sheet 3 conveyed by the reverse rollers 56.

When forming images on both sides of the sheet 3, the flapper 55 is first switched to convey the sheet 3 toward the reverse rollers 56. The reversing mechanism 52 receives the sheet 3 having an image formed on one side surface. After the sheet 3 is conveyed to the reverse rollers 56, the reverse rollers 56 rotate in a forward direction with the sheet 3 interposed therebetween, conveying the sheet 3 upward and outward along the reverse guide plate 58. Once a major part of the sheet 3 has been conveyed outward, and while the trailing edge of the sheet 3 is still interposed between the pair of reverse rollers 56, the forward rotation of the reverse rollers 56 is halted. Subsequently, the reverse rollers 56 rotate in the reverse direction to convey the sheet 3 almost directly downward toward the reconveying rollers 57. A paper sensor 66 is disposed downstream from the fixing unit 23 for detecting the trailing edge of the sheet 3. The reverse rollers 56 are switched from a forward rotation to a reverse rotation when a prescribed time has elapsed after the paper sensor 66 detects the trailing edge of the sheet 3.

After the sheet 3 has been conveyed to the reverse rollers 56, the flapper 55 is returned to its original position in order that the next sheet 3 transferred from the conveying rollers 45 is conveyed to the conveying rollers 46.

After the reverse rollers 56 convey the sheet 3 in reverse to the reconveying rollers 57, the reconveying rollers 57 convey the sheet 3 into the reconveying tray 53 that is described next.

The reconveying tray 53 includes a paper feeding unit 59 for feeding the sheet 3, a main tray 60, and skewed rollers 61.

The paper feeding unit 59 is mounted on the back of the main casing 2 below the reversing mechanism 52. The paper feeding unit 59 is provided with a curved paper guide member 62 for guiding the sheet 3 that is transferred nearly vertically downward from the reconveying rollers 57 in the reversing mechanism 52 toward a substantially horizontal direction within the paper feeding unit 59 and for conveying the sheet 3 in a substantially horizontal orientation toward the main tray 60.

The main tray 60 is formed of a substantially rectangular plate and is oriented approximately horizontally above the feed tray 6. The upstream end of the main tray 60 is linked with the curved paper guide member 62, while the downstream end is linked to the upstream end of a reconveying path 63. The downstream end of this reconveying path 63 connects to the middle of the paper conveying path for guiding the sheets 3 from the main tray 60 to the conveying rollers 9.

Two skewed rollers 61 spaced at a prescribed interval in the conveying direction of the sheet 3 are disposed along the conveying path on the main tray 60 for conveying the sheet 3 along the main tray 60 while maintaining the side edge of the sheet 3 in contact with an aligning plate (not shown).

The aligning plate not shown in the drawing is provided on one side of the main tray 60, extending widthwise along the main tray 60. The skewed rollers 61 are provided near the aligning plate. The skewed rollers 61 include skewed driving rollers 64 having axes substantially orthogonal to the conveying direction of the sheet 3, and skewed follow rollers 65 disposed in confrontation with the skewed driving rollers 64, between which the sheet 3 is interposed, and having axes slanted from a direction orthogonal to the conveying direction of the sheet 3 to a direction in which the sheet 3 is guided toward the aligning plate.

When the sheet 3 is transferred from the paper feeding unit 59 onto the main tray 60, the skewed rollers 61 convey the sheet 3 with one side edge in contact with the aligning plate once again toward the transfer position via the reconveying path 63. At this time, the front and back surfaces of the sheet 3 have been reversed. When the sheet 3 is once again conveyed to the transfer position, the back surface of the sheet 3 comes into contact with the photosensitive drum 28. A toner image is transferred from the photosensitive drum 28 to this back surface and subsequently fixed in the fixing unit 23. The sheet 3 is discharged onto the discharge tray 48 having images on both sides.

Figure 2:
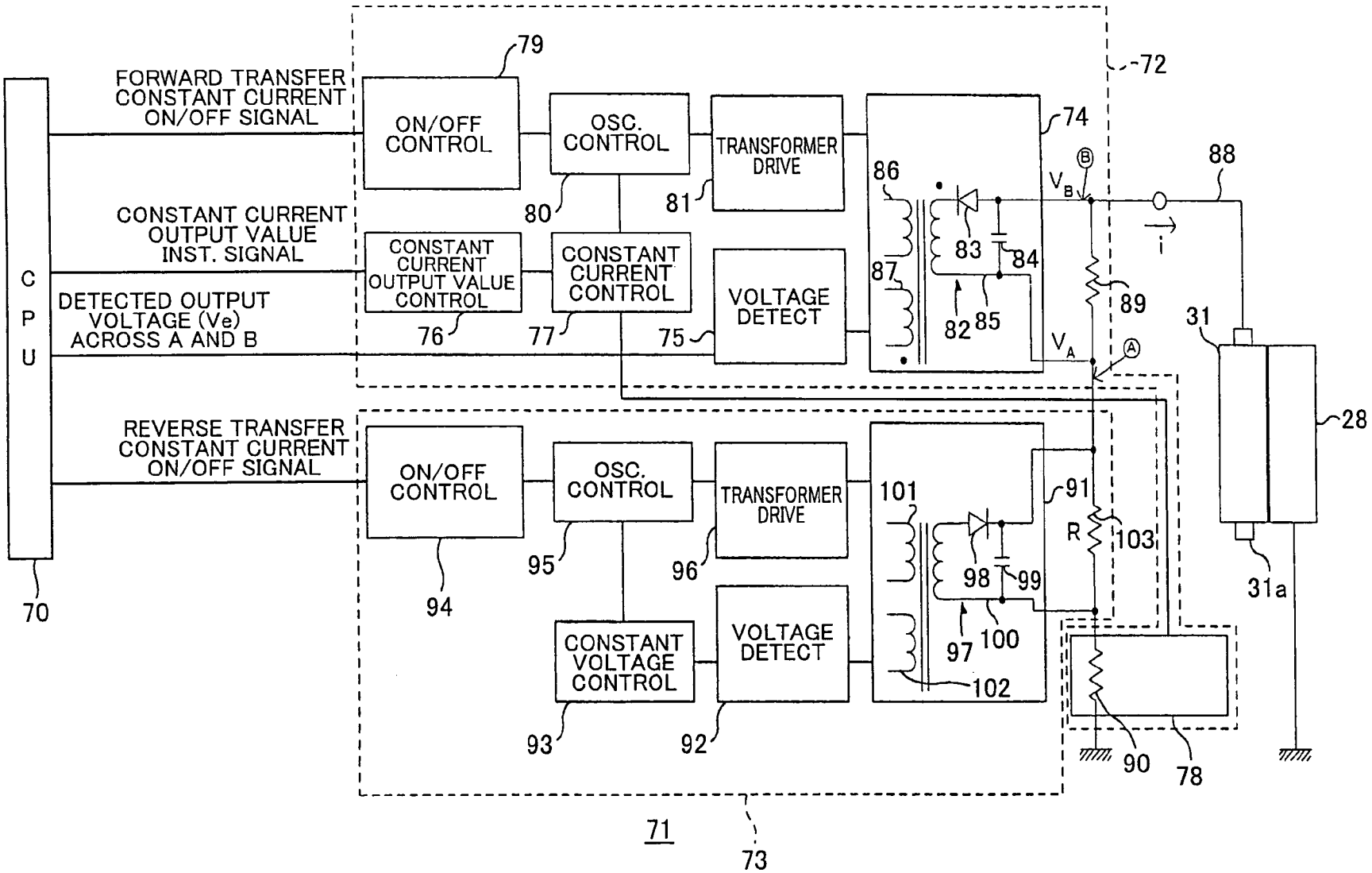
FIG. 2 is a block diagram showing the relevant parts of a transfer bias applying power source employed in the laser printer of FIG. 1.

FIG. 2 shows the transfer bias applying power source 71 connected to the transfer roller 31 to apply a bias thereto.

The transfer bias applying power source 71 is controlled by a CPU 70 and includes a forward transfer bias applying circuit 72 for applying a forward transfer bias to the transfer roller 31 during a transfer process and a reverse transfer bias applying circuit 73 for applying a reverse transfer bias to the transfer roller 31 when cleaning the same.

Through constant current control in the transfer bias applying power source 71, the forward transfer bias applying circuit 72 applies a forward transfer bias to the transfer roller 31. The reverse transfer bias applying circuit 73 applies a reverse transfer bias to the transfer roller 31 through constant voltage control. The forward transfer bias applying circuit 72 and reverse transfer bias applying circuit 73 are connected in series to the transfer roller 31. Specifically, a series connection of the forward transfer bias applying circuit 72 and the reverse transfer bias applying circuit 73 is connected to a connecting line 88 which in turn is connected to the metal roller shaft 31*a* of the transfer roller 31.

The forward transfer bias applying circuit 72 includes a forward transfer boosting/rectifying and smoothing circuit 74, a forward transfer output voltage detecting circuit 75, a constant current output value controlling circuit 76, a constant current controlling circuit 77, an output current detecting circuit 78, a forward transfer ON/OFF controlling circuit 79, a forward transfer oscillation controlling circuit 80, and a forward transfer transformer driving circuit 81.

The forward transfer boosting/rectifying and smoothing circuit 74 is further provided with a transformer 82, a diode 83, a smoothing condenser 84, and the like. The transformer 82 includes a secondary winding 85, a primary winding 86, and an auxiliary winding 87. The secondary winding 85 is connected to the connecting line 88, which is connected to the metal roller shaft 31*a*. A discharge resistor 89 is provided on the connecting line 88 at the connection between the secondary winding 85 and connecting line 88.

The secondary winding 85 and auxiliary winding 87 are wound in the transformer 82 such that the output voltage Ve detected by the forward transfer output voltage detecting circuit 75 described below is greater than or equal to 0 ($Ve \geqq 0$).

With this configuration, a ratio $\alpha$ of voltages in the secondary winding 85 and auxiliary winding 87 is less than or equal to 0 when the potential at a point B is less than or equal to 0. The voltage ratio $\alpha$ is greater than or equal to 0 when the potential at point B is greater than or equal to 0.

The diode 83 is connected to the secondary winding 85, and the smoothing capacitor 84 is connected across the secondary winding 85.

The forward transfer output voltage detecting circuit 75 is connected to both the auxiliary winding 87 in the transformer 82 and the CPU 70. During constant current control by the forward transfer bias applying circuit 72, the forward transfer output voltage detecting circuit 75 detects the output voltage generated across the secondary winding 85 (the voltage between points A and B of the secondary winding 85 in FIG. 2) and inputs this detected output voltage Ve into the CPU 70.

The constant current output value controlling circuit 76 is connected to the CPU 70 and the constant current controlling circuit 77. During constant current control by the forward transfer bias applying circuit 72, the constant current output value controlling circuit 76 controls the constant current controlling circuit 77 to output a constant current at a constant current setting i based on the instruction signals for outputting a constant current received from the CPU 70.

The constant current controlling circuit 77 is connected to the constant current output value controlling circuit 76, the output current detecting circuit 78, and the forward transfer oscillation controlling circuit 80. During constant current control by the forward transfer bias applying circuit 72, the constant current controlling circuit 77 controls the forward transfer oscillation controlling circuit 80 to output a constant current at a constant current setting $i_1$ controlled by the constant current output value controlling circuit 76.

The output current detecting circuit 78 is connected to the constant current controlling circuit 77 and includes a resistor 90 connected to the downstream end of a secondary winding 100 in a transformer 97 of a reverse transfer boosting/rectifying and smoothing circuit 91 described later. During constant current control by the forward transfer bias applying circuit 72, the output current detecting circuit 78 performs feedback control for the constant current controlling circuit 77 by detecting the output voltage and inputting this value into the constant current controlling circuit 77.

The forward transfer ON/OFF controlling circuit 79 is connected to the CPU 70 and the forward transfer oscillation controlling circuit 80. During constant current control by the forward transfer bias applying circuit 72, the forward transfer ON/OFF controlling circuit 79 turns the forward transfer oscillation controlling circuit 80 on and off according to a forward transfer constant current ON/OFF signal received from the CPU 70.

The forward transfer oscillation controlling circuit 80 is connected to the forward transfer ON/OFF controlling circuit 79, the constant current controlling circuit 77, and the forward transfer transformer driving circuit 81. During constant current control by the forward transfer bias applying circuit 72, the forward transfer oscillation controlling circuit 80 controls the forward transfer transformer driving circuit 81 to oscillate the transformer 82 based on output from the constant current controlling circuit 77.

The forward transfer transformer driving circuit 81 is connected to the forward transfer oscillation controlling circuit 80 and the forward transfer boosting/rectifying and smoothing circuit 74. The forward transfer transformer driving circuit 81 applies an oscillating current to the primary winding 86 based on oscillations of the forward transfer oscillation controlling circuit 80.

The oscillation current in the primary winding 86 is boosted and rectified in the forward transfer boosting/rectifying and smoothing circuit 74 and applied to the metal roller shaft 31*a* as a forward transfer bias. In the following description, the flow of the constant current applied by at the constant current setting $i_1$ at this time in the direction of the arrow is denoted as $i_1$ 0.

The reverse transfer bias applying circuit 73 includes the reverse transfer boosting/rectifying and smoothing circuit 91, a reverse transfer output voltage detecting circuit 92, a constant voltage controlling circuit 93, a reverse transfer ON/OFF controlling circuit 94, a reverse transfer oscillation controlling circuit 95, and a reverse transfer transformer driving circuit 96.

The reverse transfer boosting/rectifying and smoothing circuit 91 is further provided with a transformer 97, a diode 98, a smoothing capacitor 99, and the like. The transformer 97 includes a secondary winding 100, a primary winding 101, and an auxiliary winding 102. The secondary winding 100 is connected to the connecting line 88 on the downstream end of the forward transfer boosting/rectifying and smoothing circuit 74. A discharge resistor 103 is provided on the connecting line 88 at the connection between the secondary winding 100 and connecting line 88.

The diode 98 is connected to the secondary winding 100, with the polarity reversed with respect to the diode 83 in the forward transfer boosting/rectifying and smoothing circuit 74. The smoothing capacitor 99 is connected across the secondary winding 100.

The reverse transfer output voltage detecting circuit 92 is connected to the auxiliary winding 102 in the transformer 97 and the constant voltage controlling circuit 93. During constant voltage control by the reverse transfer bias applying circuit 73, the reverse transfer output voltage detecting circuit 92 performs feedback control for the constant voltage controlling circuit 93 by detecting the output voltage and inputting this value into the constant voltage controlling circuit 93.

The constant voltage controlling circuit 93 is connected to the reverse transfer output voltage detecting circuit 92 and the reverse transfer oscillation controlling circuit 95. During the constant voltage control by the reverse transfer bias applying circuit 73, the constant voltage controlling circuit 93 controls the reverse transfer oscillation controlling circuit 95 to output a constant voltage.

The reverse transfer ON/OFF controlling circuit 94 is connected to the CPU 70 and the reverse transfer oscillation controlling circuit 95. During constant voltage control by the reverse transfer bias applying circuit 73, the reverse transfer ON/OFF controlling circuit 94 turns the reverse transfer oscillation controlling circuit 95 on and off according to a reverse transfer constant current ON/OFF signal received from the CPU 70.

The reverse transfer oscillation controlling circuit 95 is connected to the reverse transfer ON/OFF controlling circuit 94, the constant voltage controlling circuit 93, and the reverse transfer transformer driving circuit 96. During constant voltage control by the reverse transfer bias applying circuit 73, the reverse transfer oscillation controlling circuit 95 controls the reverse transfer transformer driving circuit 96 to oscillate the transformer 97 based on output from the constant voltage controlling circuit 93.

The reverse transfer transformer driving circuit 96 is connected to the reverse transfer oscillation controlling circuit 95 and the reverse transfer boosting/rectifying and smoothing circuit 91. The reverse transfer transformer driving circuit 96 applies an oscillating current to the primary winding 101 based on oscillations of the reverse transfer oscillation controlling circuit 95.

The oscillation current in the primary winding 101 is boosted and rectified in the reverse transfer boosting/rectifying and smoothing circuit 91 and applied to the metal roller shaft 31*a* as a reverse transfer bias.

To apply a forward transfer bias to the transfer roller 31 during a transfer process through constant current control by the forward transfer bias applying circuit 72, the CPU 70 outputs an instruction signal for outputting a constant current to the constant current output value controlling circuit 76 and a forward transfer bias ON signal to the forward transfer ON/OFF controlling circuit 79.

Since the constant current output value controlling circuit 76 controls the constant current controlling circuit 77 based on the constant current output instruction signal, the constant current controlling circuit 77 controls the forward transfer oscillation controlling circuit 80 to output a constant current at a constant current setting $i_1$ based on this output instruction signal.

Since the forward transfer ON/OFF controlling circuit 79 turns the forward transfer oscillation controlling circuit 80 on based on a forward transfer bias ON signal received from the CPU 70, the forward transfer oscillation controlling circuit 80 causes the transformer 82 to oscillate via the forward transfer transformer driving circuit 81 based on the constant current controlling circuit 77.

The oscillation current flowing in the primary winding 86 is boosted and rectified by the forward transfer boosting/rectifying and smoothing circuit 74 and is subsequently applied to the metal roller shaft 31*a* as a forward transfer bias.

In this type of constant current control, the constant current controlling circuit 77 is able to output a constant current based on an output current value detected by the output current detecting circuit 78 and received as feedback control.

At the same time, the forward transfer output voltage detecting circuit 75 in the reverse transfer bias applying circuit 73 detects the output voltage generated across the secondary winding 85 (the voltage across points A and B of the secondary winding 85 in FIG. 2) during constant current control and inputs this detected output voltage Ve into the CPU 70.

The CPU 70 finds a resistance value Z on the transfer roller 31 end according to the following equation based on the output voltage Ve (Ve being greater than or equal to 0), the voltage ratio α of the secondary winding 85 and auxiliary winding 87 (α is less than or equal to 0 when VB is less than or equal to 0, α is greater than or equal to 0 when VB is greater than or equal to 0), the resistance R of the discharge resistor 103, and the constant current setting $i_1$ (current $i_1 \geqq 0$ in the direction of the arrow).

$$Z=(\alpha Ve-Ri_1)/i_1$$

Hence, the potential at point A in the reverse transfer bias applying circuit 73 is $$V_A=-Ri_1,$$

and the potential at point B is $$V_B=\alpha Ve+V_A=\alpha Ve-Ri_1.$$

Accordingly, the resistance value Z on the transfer roller 31 end can be found by the above equation, dividing $(\alpha Ve-Ri_1)$ by the constant current setting $i_1$.

The above equation for giving the resistance value Z on the transfer roller 31 end is applicable only in an ideal condition. However, the actual resistance value Z' may not be in coincidence with the resistance value Z as given above due to some factors or causes that vary the ideal resistance value Z, e.g., voltage generated in portions other than the reverse transfer boosting circuit. For such cases, it is desirable to adopt the following equation:

$$Z'=\{(\alpha\pm A)\cdot(Ve\pm B)\cdot D-(R\pm E)(i_1\pm F)\pm G\}/(i_1\pm H)$$

where A, B, D, E, F, G and H represent numerals determined depending on the factors or causes that vary the ideal resistance value Z.

Here, the resistance value Z or Z' on the transfer roller 31 end includes the resistance of the transfer roller 31, the photosensitive drum 28 contacting the transfer roller 31, and, during a transfer process, the sheet 3 interposed between the transfer roller 31 and the photosensitive drum 28.

By detecting the resistance value Z on the transfer roller 31 end based on the above equation, the resistance value Z can be found while considering not only the output voltage Ve detected by the forward transfer output voltage detecting circuit 75, but also the resistance R of the discharge resistor 103 on the reverse transfer bias applying circuit 73 side.

Accordingly, with a simple construction, it is possible to detect the resistance value Z on the transfer roller 31 end with accuracy.

When transferring toner with the forward transfer bias applying circuit 72, the CPU 70 determines a constant current based on the resistance value Z on the transfer roller 31 end found as described above. The CPU 70 outputs a constant current output value instruction signal, based on which the forward transfer bias applying circuit 72 applies a forward transfer bias to the transfer roller 31.

In this way, the laser printer 1 can calculate an appropriate constant current value with accuracy. Accordingly, the laser printer 1 can achieve high-quality image formation by applying this appropriate forward transfer bias to the transfer roller 31.

Moreover, the resistance value Z on the transfer roller 31 end includes the resistance value of the transfer roller 31, the photosensitive drum 28 connected to the transfer roller 31, and, during the transfer process, the sheet 3 interposed between the transfer roller 31 and photosensitive drum 28. Since all resistance values are considered, the forward transfer bias applying circuit 72 can apply an even more appropriate forward transfer bias to the transfer roller 31.

By finding the resistance value Z on the transfer roller 31 end using the above equation, the resistance value Z can be calculated through a simple standard process. Hence, an accurate and appropriate constant current value can be determined through simple control.

Since the forward transfer output voltage detecting circuit 75 is connected to the auxiliary winding 87 of the transformer 82, the forward transfer bias applying circuit 72 can reliably detect the output voltage Ve through a simple configuration. Accordingly, the forward transfer bias applying circuit 72 can apply an appropriate and accurate forward transfer bias based on an even more accurate detection of the resistance value Z on the transfer roller 31 end.

To apply a reverse transfer bias to the transfer roller 31 during a cleaning period through constant voltage control by the reverse transfer bias applying circuit 73, the CPU 70 outputs a reverse transfer bias ON signal to the reverse transfer ON/OFF controlling circuit 94.

Since the reverse transfer ON/OFF controlling circuit 94 turns the reverse transfer oscillation controlling circuit 95 on based on the reverse transfer bias ON signal received from the CPU 70, the reverse transfer oscillation controlling circuit 95 oscillates the transformer 97 through the reverse transfer transformer driving circuit 96 based on the constant voltage controlling circuit 93.

After the oscillation current flowing in the primary winding 101 is boosted and rectified by the reverse transfer boosting/rectifying and smoothing circuit 91, the current is applied to the metal roller shaft 31*a* at a fixed voltage as the reverse transfer bias.

During this type of constant voltage control, the constant voltage controlling circuit 93 can output a fixed current through feedback control based on the output voltage detected by the reverse transfer output voltage detecting circuit 92.

Hence, during a transfer process to transfer a toner image to the sheet 3, the CPU 70 controls the transfer bias applying power source 71, as described above, to apply a forward transfer bias at a potential lower than the surface potential of the photosensitive drum 28 in contact with the transfer roller 31 (−12 $\mu$A, for example) through the constant current control by the forward transfer bias applying circuit 72. By applying this forward transfer bias, the toner image formed on the photosensitive drum 28 can be reliably transferred to the surface of the sheet 3 passing between the photosensitive drum 28 and the transfer roller 31.

During a transfer operation, changes in the environment (changes in humidity) can change the resistance in the transfer roller 31, sheet 3, and photosensitive drum 28, varying the resistance value Z on the transfer roller 31 end. However, the forward transfer bias applying circuit 72 can determine an appropriate constant current value corresponding to changes in the resistance value Z on the transfer roller 31 end, as described above. Since an appropriate transfer current can always be applied to the transfer roller 31, it is possible to maintain good transfer capability.

Since the transfer roller 31 in the laser printer 1 of the preferred embodiment is configured of an ion-conducting transfer roller covered with a roller member formed of a resilient ion-conducting material, the present invention can greatly reduce irregularities along the roller. While resistance values change greatly due to ambient changes (changes in humidity), the present invention can apply a suitable forward transfer bias through the constant current control by the forward transfer bias applying circuit 72.

The laser printer 1 also performs a cleaning operation before or after an image forming process or between operations to transfer images to sheets 3 during the image forming process. In this cleaning operation, a reverse transfer bias greater than the surface potential of the photosensitive drum 28 in contact with the transfer roller 31 (1.6 kV, for example) is applied to the transfer roller 31 through the constant voltage control of the reverse transfer bias applying circuit 73. By applying this reverse transfer bias to the transfer roller 31, toner deposited on the surface of the transfer roller 31 during the transfer process is electrically expelled onto the photosensitive drum 28, thereby satisfactorily cleaning the transfer roller 31. As described above, a cleanerless developing system is employed, whereby the developing roller 34 recovers the toner attracted to the photosensitive drum 28.

As described above, the CPU 70 in the laser printer 1 can accurately detect the resistance value Z on the transfer roller 31 end during constant current control. Hence, an appropriate forward transfer bias (constant current setting i) can be selected based on the size and thickness of the sheet 3 and the resistance value Z on the transfer roller 31 end. When the forward transfer bias applying circuit 72 applies this selected forward transfer bias, a forward transfer bias corresponding to the size and thickness of the sheet 3 to which an image is being transferred can be applied according to the resistance value Z detected at any time, even when the size and thickness of the sheet 3 or the resistance in the transfer roller 31 changes. Hence, it is possible to achieve optimal transfers based on the size and thickness of the sheet 3 through constant current control.

In the preferred embodiment described above, the transfer roller 31 is described as an example of the biasing member of the present invention, but the biasing member can be any member contacting the image carrying member (photosensitive drum 28) to which a forward or reverse bias is applied. For example, the biasing member can be the developer carrying member (developing roller 34), the charging means (charging roller), the cleaning means (cleaning roller), or the like.

What is claimed is:

1. An image forming device comprising:

an object to be biased;

a bias applying power source that applies a bias to the object, the bias applying power source comprising a forward bias applying circuit and a reverse bias applying circuit connected in series to the object, the forward bias applying circuit applying a forward bias to the object according to a constant current control and comprising a voltage detecting circuit that detects an output voltage from the forward bias applying circuit; and resistance detecting means for detecting a resistance on the object based on the output voltage detected by the voltage detecting circuit and a resistance on the reverse bias applying circuit when the forward bias applying circuit executes constant current control.

2. The image forming device according to claim 1, wherein the forward bias applying circuit further comprises a booster circuit connected to the object, the booster circuit including a transformer having a primary winding, a secondary winding, and an auxiliary winding to which the voltage detecting circuit is connected.

3. The image forming device according to claim 2, wherein the auxiliary winding is provided at a primary winding side.

4. The image forming device according to claim 3, wherein the resistance detecting means determines the resistance on the object based on equation $Z=(\alpha Ve-Ri_1)/i_1$, where Z is a resistance on the object, $\alpha$ is a ratio of voltages in the secondary winding and auxiliary winding, Ve is a voltage detected by the voltage detecting circuit, R is a resistance on the reverse bias applying circuit, and $i_1$ is a constant current set for constant current control.

5. The image forming device according to claim 3, wherein the resistance detecting means determines the resistance on the object based on equation $$Z=\{(\alpha\pm A)\cdot(Ve\pm B)\cdot D-(R\pm E)(i_1\pm F)\ \pm G\}/(i_1\ \pm H)$$

in order to take factors or causes that vary the resistance value Z into consideration where Z is a resistance on the object, $\alpha$ is a ratio of voltages in the secondary winding and auxiliary winding, Ve is a voltage detected by the voltage detecting circuit, R is a resistance on the reverse bias applying circuit, and $i_1$ is a constant current set for constant current control and A, B, D, E, F, G and H represent numerals determined depending on the factors or causes that vary the resistance value Z.

6. The image forming device according to claim 1, wherein the forward bias applying circuit determines and applies a bias value based on a resistance on the object detected by the resistance detecting means.

7. The image forming device according to claim 1, further comprising an image carrying member for carrying a developer image, the image carrying member being disposed in contact with the object.

8. The image forming device according to claim 7, wherein the object is a transfer roller and the image carrying member is a photosensitive drum wherein the transfer roller transfers the developer image on the photosensitive drum onto a sheet of paper.

9. The image forming deice according to claim 1, wherein the object is a roller member formed of a resilient ion-conducting material.

* * * * *